US005302321A

United States Patent [19]

Akama et al.

[11] Patent Number: 5,302,321

[45] Date of Patent: Apr. 12, 1994

[54] ANTICORROSIVE METHOD OF STREAM AND CONDENSER SYSTEMS

[75] Inventors: Shunichi Akama; Takanobu Sasa, both of Ibaragi; Tokuko Yanagisawa, Tokyo, all of Japan

[73] Assignee: Aquas Corporation, Tokyo, Japan

[21] Appl. No.: 860,493

[22] PCT Filed: Mar. 28, 1991

[86] PCT No.: PCT/JP91/00410

§ 371 Date: Jun. 17, 1992

§ 102(e) Date: Jun. 17, 1992

[87] PCT Pub. No.: WO91/15612

PCT Pub. Date: Oct. 17, 1991

[30] Foreign Application Priority Data

Mar. 30, 1990 [JP] Japan ..... 2-81011

[51] Int. Cl.[5] ..... C23F 11/12

[52] U.S. Cl. ..... 252/396; 422/13

[58] Field of Search ..... 252/396; 422/12, 13, 422/14

[56] References Cited

U.S. PATENT DOCUMENTS

| | | | |
|---|---|---|---|
| 4,278,683 | 7/1981 | Stotefuss et al. | 424/267 |
| 4,569,783 | 2/1986 | Muccitelli | 252/396 |
| 5,094,814 | 3/1992 | Soderquist et al. | 422/16 |
| 5,108,624 | 4/1992 | Bossler et al. | 210/750 |

*Primary Examiner*—Robert L. Stoll
*Assistant Examiner*—Valerie Fee
*Attorney, Agent, or Firm*—Lowe, Price, Leblanc & Becker

[57] ABSTRACT

The corrosion of steam and condenser systems and piping therefor is minimized by the addition of anti-corrosion amounts of Vitamin A or Vitamin E.

4 Claims, 1 Drawing Sheet

ANTICORROSIVE METHOD OF STREAM AND CONDENSER SYSTEMS

FIELD OF INVENTION

The present invention relates to a method of preventing the occurrence of corrosion in pipes and devices of steam and condenser systems.

BACKGROUND ART

In steam generating apparatuses, such as boilers and concentration cans, the metal in contact with steam and condensed water may corrode due to feed water-containing oxygen and components of M-alkalinity. Regarding to condenser systems in particular, carbon dioxide generated together with steam in boilers and the like dissolves again in water at condensation of steam, leading to the decrease in pH of condensed water (condensation), which frequently causes severe corrosion of pipes and devices. As the methods to prevent such corrosion, there has been conventionally carried out the chemical process with strong basic-type amines such as morpholine and long-chain aliphatic amines such as octadecyl amine, besides the processes of ion exchange and degassing for the objective to degass carbonate in feed water.

In case that the steam generated in boilers is to be used for food processing and the production process of pharmaceutical agents and for humidification of air conditioning of buildings, a high degree of hygienic safety is required for steam. Some of the amine-type chemical agents described above have received approval for their use as the additives for boilers from U.S. FDA Standards, but the objectives of the utility of generated steam have been limited and the concentration of the agents in steam also has limitation. Additionally, they are not necessarily satisfactory in terms of safety. Hence, even in the case that some concerns about the corrosion of pipes and devices of steam and condenser systems may be present, steam is used without chemical processing, in order to ensure safety.

DISCLOSURE OF THE INVENTION

The present invention is thus to provide an anticorrosive method of steam and condenser systems, capable of providing sufficient ensuring of hygienic safety.

The present inventors have carried out investigations so as to achieve the above objectives, and have found that vitamin A and vitamin E, among vitamins as the organic substances inevitable for maintaining normal growth and nutritious state of animals, have anticorrosive effect on steam and condenser systems. That is, the present invention is an anticorrosive agent of steam and condenser systems, containing vitamin A or E as the effective component thereof, and an anticorrosive method of steam and condenser systems wherein at least one compound selected from the group consisting of vitamin A and vitamin E is added to the systems.

The vitamin A to be used in the present invention is;

(a) vitamin A compounds including vitamin $A_1$ (retinol), vitamin $A_2$, vitamin $A_3$, etc., or (b) the derivatives of the vitamin A compounds described above, including vitamin A aliphatic acid ester, vitamin A acid, vitamin A aldehyde, etc., and they may be natural products or synthetic products, or those containing such compounds or derivatives, for example, fatty oil obtained from liver and pyrolus uvula of marine animals.

The vitamin E to be used in the present invention is represented by so-called tocopherol and its analogs, including for example, α-tocopherol, β-tocopherol, γ-tocopherol, δ-tocopherol, α-tocotorienol, β-tocotorienol, γ-tocotorienol, δ-tocotorienol, etc. As in vitamin A, oils containing such compounds, for example, germ oil and soybean oil, may be also included.

These vitamins A and E are those incorporated as nutritious components on daily basis into humans, and are substances in a wide range of general use as supplementary products for nutritious foods or additives for milk products, flour, baby foods, condensed and dried soup stocks, curry roux, confectioneries, etc. Vitamins A and E as such are thoroughly investigated of their safety including the effects on human body, so they can appropriately be used in the case that safety of steam is important as described above.

The anticorrosive mechanism is not clear in accordance with the present invention, but such anticorrosive property of vitamins A and E cannot be expected from the properties and utilities thereof, and the property is very surprising.

These vitamin A and vitamin E may be used singly or in combination with each other, or may be used as a pharmaceutical agent in which these vitamins are blended together. The method of adding vitamin A, vitamin E or the mixture thereof, and the concentration thereof to be added should be appropriately determined, depending on equipment condition and the condition as to how to use, and it is generally preferable to directly inject and add them to the pipes of steam or condenser system. The longer the length of pipes of steam or condenser systems gets, the higher the concentration to be added should be. Vitamins A and E are also sparingly soluble in water, and in case that preliminary dilution of them is advantageous at their addition, they may be dispersed in emulsifiers or diluted with solvents, before adding and using them.

BEST MODE OF CARRYING OUT THE INVENTION

Figure 1:
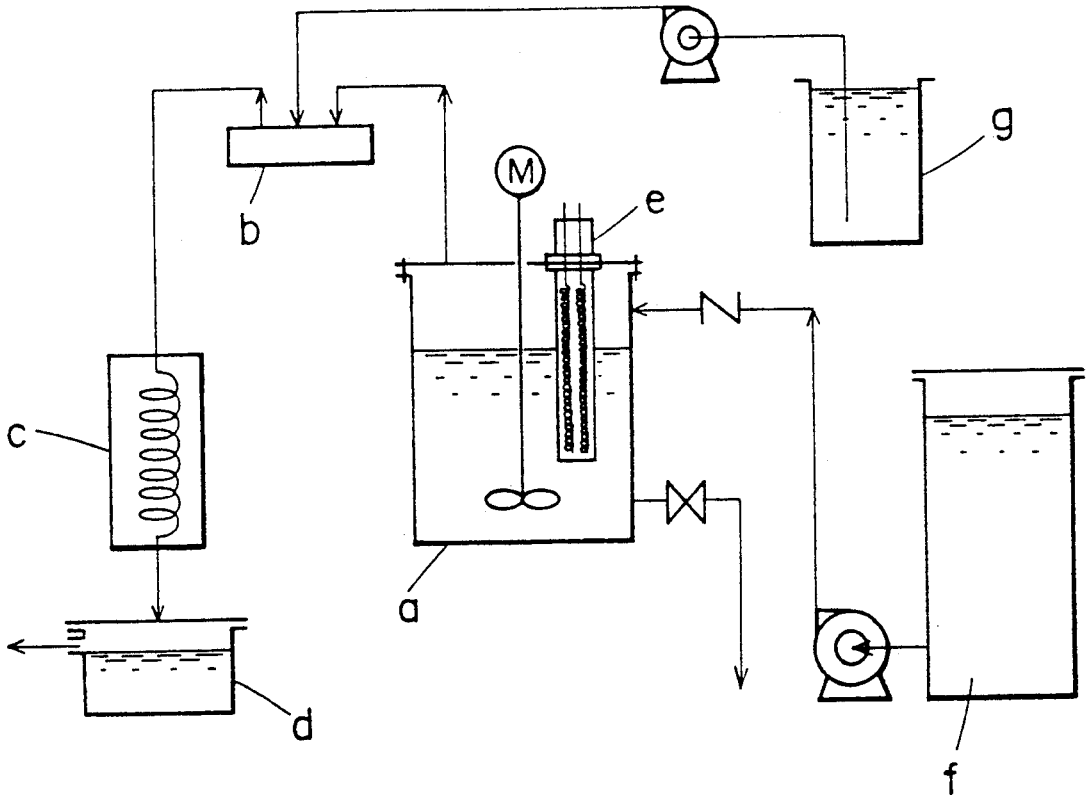
FIG. 1 is a figure representing the configuration of a testing apparatus to carry out the anticorrosive method of steam and condenser systems in accordance with the present invention.

While supplying soft water f of the following water quality to autoclave a where as shown in FIG. 1, steam header b, water cooling type steam condenser c following the header b, and condensed water (condensation) pool d following the condenser c, were communicated together, and thermal electric heater e (conductive heat area 0.67 $m^2$) was immersed in water, operation was effected at a steam pressure of 8 kg f/$cm^2$, a steam generation volume of 5.5 kg/h, a blower ratio of 10%, and the water temperature in the condensation water pool d of 70° C., until the final accumulation of feed water reached 200 l. The decrease in corrosion of a soft steel board of 15 mm×40 mm×2 mm, suspended in the condensed water pool d, was measured to calculate the corrosion degree (mdd). Chemical agents g used are as follows, and the agents were injected into the steam header b at their ratios to condensed water as shown in FIG. 1. No chemical agents were injected into the autoclave a.

The results are shown as FIG. 1, and excellent anticorrosive effect was obtained.

| | |
|---|---|
| Quality of soft water | |
| pH | 7.5 |
| Electric conductivity (μS/cm) | 200 |
| M-alkalinity (mg $CaCO_3$) | 48 |
| Silica (mg $SiO_2$) | 24 |
| Chloride ion (mg Cl/l) | 13 |
| Whole hardness (mg $CaCO_3$) | less than 1 |
| Chemical agents used | |
| Chemical agent A: | |
| Vitamin A (Riken A palmitate 1000) | 1% |
| Benzyl alcohol | 99% |
| Chemical agent B: | |
| Vitamin A (Riken A palmitate 1000) | 4.1% |
| Benzyl alcohol | 95.9% |
| Chemical agent C: | |
| Vitamin E (E mix 60) | 1% |
| Benzyl alcohol | 99% |
| Chemical agent D: | |
| Benzyl alcohol | 100% |
| Chemical agent E: | |
| Octadecyl amine | 1.4% |
| Polyoxyethylene stearylether | 0.4 |
| Water | 98.2% |
| Chemical agent F: | |
| 2-Amino-3-methyl propanol | 17.5% |
| Water | 82.5% |

TABLE 1

| Test No. | Chemical agent | Amount added | Corrosion degree(mdd) | Note |
|---|---|---|---|---|
| 1 | blank | | 125 | |
| 2 | A | 600 | 22 | Example |
| 3 | B | 600 | 34 | Example |
| 4 | C | 600 | 29 | Example |
| 5 | D | 600 | 124 | Comparative Example |
| 6 | E | 600 | 41 | Comparative Example |
| 7 | F | 600 | 27 | Comparative Example |

INDUSTRIAL UTILIZATION OF THE INVENTION

Because an anticorrosive agent containing as the effective component at least one compound selected from vitamin A or vitamin E is injected into steam pipes or into boilers, the application of the anticorrosive method of steam and condenser systems in accordance with the present invention allows the use of the steam for food processing and the like, with no concerns about the occurrence of steam contamination and the corrosion of the pipes due to chemical agents and the like.

What is claimed is:

1. A method for inhibiting corrosion in steam condenser systems which comprises adding thereto an anticorrosive amount of Vitamin A.

2. A method according to claim 1, wherein the Vitamin A is added in admixture with an emulsifier.

3. A method according to claim 1, wherein the Vitamin A is added in admixture with a solvent.

4. A method according to claim 1, wherein about 1% to 4.1% of the Vitamin A is added to the system.

* * * * *